United States Patent [19]

Gold

[11] Patent Number: 4,667,848

[45] Date of Patent: May 26, 1987

[54] COOPERATING CAP, RETAINER RING AND CONTAINER GLOBE FOR CONFECTION PRODUCT DISPENSING MACHINE

[75] Inventor: Arthur Gold, Northbrook, Ill.

[73] Assignee: Carousel Industries Inc., Morton Grove, Ill.

[21] Appl. No.: 804,442

[22] Filed: Dec. 4, 1985

[51] Int. Cl.[4] ..... A47F 3/026

[52] U.S. Cl. ..... 221/155; 221/281; 221/154; 403/380

[58] Field of Search ..... 194/251, 254–256, 194/296, 297, 350; 403/380, 97; 220/353, 327, 328; 221/154, 155, 281, 24, 265; 222/154, 158

[56] References Cited

U.S. PATENT DOCUMENTS

| | | | |
|---|---|---|---|
| 898,995 | 9/1908 | Simpson | 194/256 |
| 1,239,753 | 9/1917 | Antoine et al. | 221/281 |
| 1,425,531 | 8/1922 | Mabey | 194/251 |
| 1,441,438 | 1/1923 | Leonhardt | 194/297 |
| 2,880,906 | 4/1959 | Probasco | 221/265 |
| 3,317,225 | 5/1967 | Cooper | 403/97 |
| 3,804,294 | 4/1974 | Householder | 221/154 |

*Primary Examiner*—H. Grant Skaggs

*Attorney, Agent, or Firm*—Silverman, Cass, Singer & Winburn, Ltd.

[57] ABSTRACT

A machine for dispensing granular confectionery, such as gumballs, peanuts, and the like, which includes a housing, a container globe seated on the housing, a cap seated on the globe and a vertical standard extending interior of the housing and globe and including a threaded end. A retainer ring is seated on the globe with a gasket interposed. The inlet to the globe carries opposing deformations in the form of notches in the perimeter of the entrance opening of the globe. The retainer ring carries depending lugs seatable in the notches. The cap can be tightened onto the globe with the lugs seated in the notches so as to prevent relative rotation between the retainer ring and globe during tightening of the cap and thereby prevent possible damage to the globe, such as breaking or cracking it.

4 Claims, 4 Drawing Figures

FIG. 1
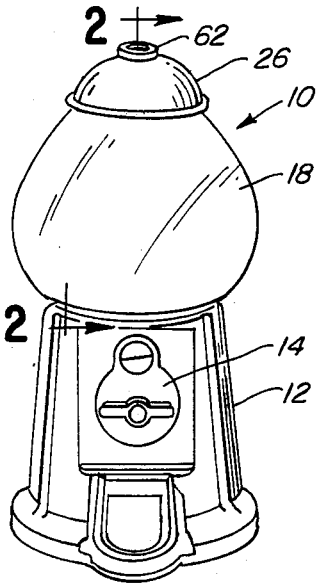
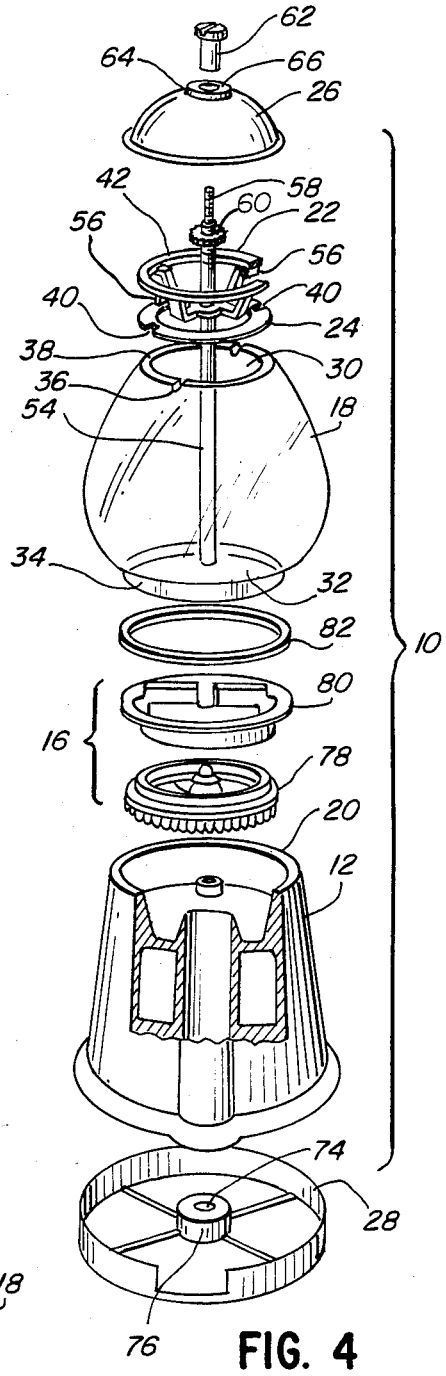
FIG. 4
FIG. 3
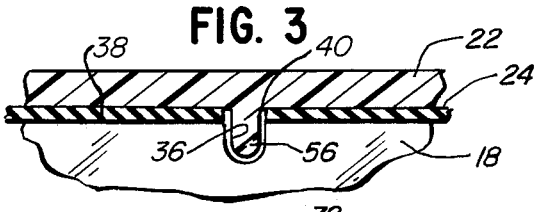
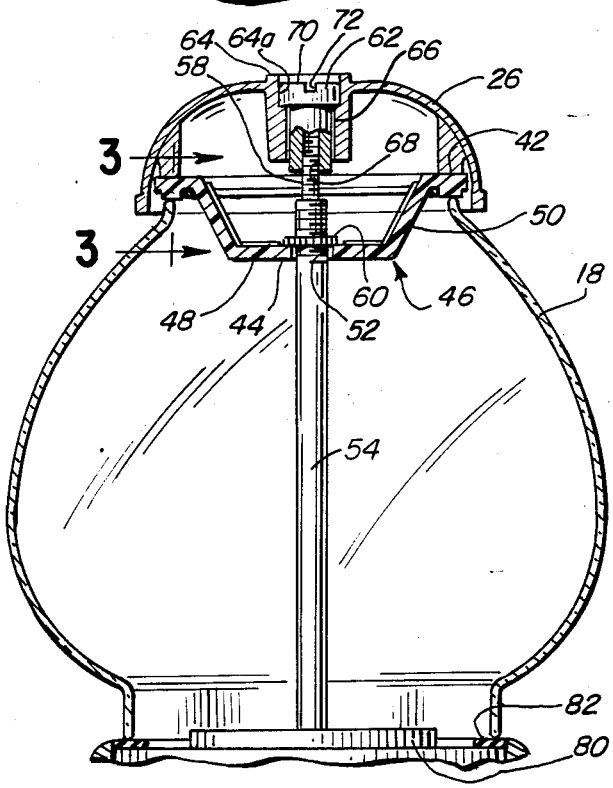
FIG. 2

COOPERATING CAP, RETAINER RING AND CONTAINER GLOBE FOR CONFECTION PRODUCT DISPENSING MACHINE

BACKGROUND OF THE INVENTION

This invention relates generally to coin or non-coin operated vending machines for dispensing granular products, such as gumballs, candy, peanuts and the like, and in particular, provides a cooperating cap, retainer ring and container globe, including means for preventing rotation of the globe relative to the retainer ring during assembly of the machine.

Machines of the coin or non-coin operated type for dispensing granular confectionery, such as gumballs, candy, peanuts and the like, are widely used. Machines of this type generally include a container globe of glass, usually, seated on a rigid housing in which a dispensing mechanism is installed. The housing also includes a base plate. In addition to the container globe and dispensing mechanism, there also is provided means for securing the globe to the housing and a cap with retainer ring for closing off the open end of the globe. The machine assembly is completed by passing a support rod axially through the assembly of parts, the support rod having a threaded end portion which extends to the cap. The cap is tightened on the globe by means of a screw plug or the like which is threaded to the end of the support rod. The rod usually is provided with an enlarged head at its opposite end which seats in the base plate. Gasketting usually is provided between mating surfaces of parts with the intention of preventing damage to the globe, during tightening of the cap on the globe as assembly of the machine is completed.

A serious problem is encountered during assembly of the machine where the cap and retainer ring assembly must be installed on the globe. Heretofore, these were movable relative to the upper perimeter edge of the globe as the screw plug was being tightened. To prevent such movement, pressure had to be applied against the cap to restrain such movement during such a tightening operation. It was possible to break or crack the globe inadvertently during such a procedure and this did occur often enough to present the problem. The globe had to be replaced by the machine vender or owner during which time the machine was inoperative.

SUMMARY OF THE INVENTION

A coin or non-coin operated confectionery dispensing machine including a container globe having a top entrance and a bottom outlet, a housing containing a dispensing mechanism, a base plate for receiving the bottom portion of the housing, a retainer ring seatable on the entrance of the globe and a cap seatable over the retainer ring, an elongate rigidifying member of a length and configuration to traverse the interior of the assembled dispensing machine along the central axis thereof and fastening means to complete the assembly. Suitable gaskets are provided at the junctions of the globe, the retainer ring and the base plate. Cooperating lugs and notches are formed on the retainer ring and globe respectively to restrain the relative movement of the globe and retainer ring during tightening of the fastening means to complete the assembly of the dispensing machine.

BRIEF DESCRIPTION OF THE DRAWINGS

FIG. 1 is an elevational view of a confectionery dispensing machine constructed in accordance with the invention;

FIG. 2 is a sectional view taken along lines 2—2 of FIG. 1 and viewed in the direction indicated;

FIG. 3 is a fragmentary sectional detail taken along lines 3—3 of FIG. 2 and viewed in the direction indicated; and, FIG. 4 is an exploded perspective view illustrating the construction and assembly of the dispensing machine of FIGS. 1 and 2.

DESCRIPTION OF PREFERRED EMBODIMENT

The invention will be described as embodied in a confectionery dispensing machine known generally as a gumball machine. The machine also is capable of dispensing other granular-type products, such as candy, peanuts, small toys or the like. In particular, the invention is directed to providing novel means for preventing damage to the relatively fragile container globe of the machine when the machine is being assembled and to facilitate the assembly process, as well.

Referring now to the drawing, a dispensing machine in which the invention is shown designated generally 10 in FIG. 1. Machine 10 includes a housing 12 carrying dispensing means 14, interior feed means 16 (see FIG. 4) and a frangible globe 18, usually of glass, for containing the product to be dispensed. The globe 18 is seated on the upper portion 20 of the housing 12. A retaining ring 22 and gasket 24 is seated on globe 18, these being shown in detail in FIG. 4. The assembled machine 10 is topped off by cap 26 with the bottom of the housing 12 seated within a base plate 28.

Referring to FIG. 4, the globe 18 conventionally formed of glass or other usually frangible material, has an entrance 30 and an outlet 32 coaxial one with the other. An annular depending flange 34 is formed unitary with the globe 18. A pair of notches 36 or depressions is formed in the rim or perimeter 38 which defines the entrance 30. The notches 36 are diametrically opposed to one another in rim 38. Each may be formed at the time the globe 18 is fabricated or any other conventional procedure may be used. The rim is of sufficient width to permit seating of ring gasket 24 thereon. Gasket 24 carries diametrically opposite notches 40 which open to the outer periphery of said gasket 24 so as to coincide with the notches 36.

Retainer ring 22 is to be assembled to the globe 18. The retainer ring 22 has an outer rim 42 and a center ring 44 located substantially below the level of the rim 42 and connected thereto by radial arms 46 in the form of a so-called "spider". The inner portions 48 of arms 46 are coplanar with the ring 44. The remaining portions 50 of said arms 46 are angled upward to join the rim 42. Central passage 52 is formed in ring 44 having a diameter selected to accommodate a rigid support rod 54 therethrough.

Depending tabs or lugs 56 are formed on the undersurface of rim 42 at diametrically spaced locations. The tabs or lugs 56 are dimensioned to pass through gasket notches 40 and seat in the globe notches 36. The rim 42 of the retainer ring 22 will be seated on the rim 38 of globe 18.

The support rod 54 has a threaded end 58 and carries annular washer 60 adapted to engage the center ring 44 when assembly of the machine 10 is completed.

The entrance opening 30 is to be closed off by the cap 26. Cap 26 is generally hemispherical in configuration and has a boss formation 64 with a central bore 66 therethrough at the apex of the cap. The threaded end 58 of rod 54 extends through bore 66 when the cap 26 is installed on the globe 18 over the seated retaining ring 22 and gasket 24. Screw plug or fastener 62 is inserted through bore 66 to engage the threaded end 58 for tightening up on the entire machine assembly. The head 70 of screw plug 62 has a groove 72 for a screwdriver blade, or even a coin inserted edgewise into it for tightening plug 62 on threaded end 58. The fastener 62 is shown as received countersunk at 64*a* in cap 26. The opposite end (not shown) of the rod 54 is received within a cavity 74 formed in the central hub or ring 76 of the base plate 28.

In the assembled condition of machine 10, the rod 54 extends from boss 76, through the housing 12, adjustable wheel 78, the assembled brush-off plate 80, through the globe 18 to the cap 26, as shown in FIG. 4 to be screw tightened to fastener 62. The brush-off plate 80 illustrated in FIG. 4 is shown in reverse position.

It will be appreciated that more than two notches 30 and lugs 56 for cooperating locking means may be provided. Thus, the cooperative engagement of retainer ring 22 with the perimetric edge 38 of the globe prevents relative rotation therebetween during tightening of fastener 62 on threaded end 58 of the support rod. In this way, undue pressure exerted against cap 26 is avoided with possible consequent damage to the globe or bowl 18.

I claim:

1. In a confectionary dispensing machine which includes a housing having a dispensing mechanism operable therein with a seat for a confectionary container globe and means for assembling the globe to the housing which includes a unitary rod threaded at its upper end and extending lengthwise through the machine, including substantially centrally through said globe, the combination comprising, a frangible container globe having an upper entrance end and an exit end adapted to communicate with the dispensing mechanism when assembled to the housing, and a spider-like retainer member seated on the globe at said entrance end, the perimeter edge of said entrance end of said globe having at least one notch therein and said retainer member having cooperating locking means engageable to prevent relative rotation therebetween when the globe is assembled to the machine, said locking means including said at least one notch in said perimeter edge of said entrance end of said globe and a depending lug on said retainer member for engaging in said notch and including a cap secured about said entrance end including a fastener member threadedly engageable with said threaded end of the rod for maintaining the cap, retainer member and globe assembled together, said cap having an edge extending downwardly around and beyond said entrance edge of said globe.

2. The combination of claim 1 in which a pair of said notches and lugs are symmetrically disposed on said globe and said retainer ring respectively.

3. The combination of claim 1 wherein said retainer member includes inner and outer concentric rings and integral radial arms symmetrically arranged between and connecting said rings, the outer ring seatable at the entrance above said globe and said inner ring being within said globe, said locking means comprising the outer ring including depending lugs and said globe having said at least one notch for receiving said lugs therein.

4. The combination of claim 3 wherein said fastening member comprises a cap screw capable of being secured to said threaded end of the rod.

* * * * *